US010400608B2

(12) United States Patent
Coomer et al.

(10) Patent No.: US 10,400,608 B2
(45) Date of Patent: Sep. 3, 2019

(54) COOLING STRUCTURE FOR A TURBINE COMPONENT

(71) Applicant: General Electric Company, Schenectady, NY (US)

(72) Inventors: Jessica Elizabeth Coomer, Hamilton, OH (US); Matthew Thomas Beyer, West Chester, OH (US); Stephen Molter, Cincinnati, OH (US); Aaron Ezekiel Smith, Montgomery, OH (US)

(73) Assignee: General Electric Company, Schenectady, NY (US)

( * ) Notice: Subject to any disclaimer, the term of this patent is extended or adjusted under 35 U.S.C. 154(b) by 273 days.

(21) Appl. No.: 15/360,529

(22) Filed: Nov. 23, 2016

(65) Prior Publication Data

US 2018/0142559 A1 May 24, 2018

(51) Int. Cl.

*F01D 5/18* (2006.01)
*F01D 5/30* (2006.01)
*F01D 5/20* (2006.01)

(52) U.S. Cl.

CPC ..... *F01D 5/187* (2013.01); *F01D 5/20* (2013.01); *F01D 5/3007* (2013.01); *F05D 2220/32* (2013.01); *F05D 2240/307* (2013.01); *F05D 2250/25* (2013.01); *F05D 2250/70* (2013.01);

(Continued)

(58) Field of Classification Search

CPC ..... F05D 2240/307; F05D 2260/202; F05D 2260/2212; F01D 5/18; F01D 5/187; F01D 5/20; F01D 5/147

See application file for complete search history.

(56) References Cited

U.S. PATENT DOCUMENTS 4,487,550 A * 12/1984 Horvath ..... F01D 5/20 416/92
5,660,523 A * 8/1997 Lee ..... F01D 5/20 415/115
5,738,491 A 4/1998 Lee et al.

(Continued)

FOREIGN PATENT DOCUMENTS

| | | | |
|---|---|---|---|
| AU | 2004202946 | A2 | 2/2005 |
| EP | 2469030 | A2 | 6/2012 |
| GB | 2279705 | A | 1/1995 |

OTHER PUBLICATIONS

International Search Report and Written Opinion issued in connection with corresponding PCT Application No. PCT/US2017/060021 dated Jul. 26, 2018.

*Primary Examiner* — Dwayne J White
*Assistant Examiner* — Jackson N Gillenwaters
(74) *Attorney, Agent, or Firm* — General Electric; Brian Overbeck

(57) ABSTRACT

A tip cooling apparatus for a turbine airfoil includes: a tip cap; a pair of spaced-apart tip walls connected to, extending around, and projecting outwardly from the tip cap so as to surround a central portion of the tip cap; a pocket defined by the tip walls; at least one feed hole passing through the tip cap or tip walls, communicating with the pocket; and a cooling matrix disposed in the pocket, the cooling matrix being an organized structure including an inlet surface having a plurality of inlets communicating with the pocket, and an outlet surface having a plurality of outlets, and further comprising a plurality of interior passages interconnecting the inlets to the outlets, with no line-of-sight therebetween.

22 Claims, 10 Drawing Sheets

(52) U.S. Cl.
CPC .. *F05D 2260/202* (2013.01); *F05D 2260/203* (2013.01); *F05D 2260/204* (2013.01)

(56) References Cited

U.S. PATENT DOCUMENTS

| | | | | |
|---|---|---|---|---|
| 6,135,715 | A | 10/2000 | Correia | |
| 6,155,778 | A * | 12/2000 | Lee | F01D 5/20 415/116 |
| 6,461,107 | B1 * | 10/2002 | Lee | F01D 5/183 29/889.1 |
| 7,402,335 | B2 * | 7/2008 | Bolms | C23C 28/3215 428/305.5 |
| 7,413,001 | B2 | 8/2008 | Wang et al. | |
| 7,537,431 | B1 | 5/2009 | Liang | |
| 7,997,865 | B1 | 8/2011 | Liang | |
| 8,061,987 | B1 | 11/2011 | Liang | |
| 8,801,377 | B1 | 8/2014 | Liang | |
| 9,039,917 | B2 | 5/2015 | Szuromi et al. | |
| 9,249,670 | B2 | 2/2016 | Bunker | |
| 9,297,262 | B2 | 3/2016 | Zhang et al. | |
| 10,036,258 | B2 * | 7/2018 | Mongillo | F01D 5/187 |
| 2010/0119377 | A1 * | 5/2010 | Tibbott | F01D 5/186 416/97 R |
| 2011/0262695 | A1 | 10/2011 | Lee et al. | |
| 2015/0068629 | A1 | 3/2015 | Kottilingam et al. | |
| 2015/0144496 | A1 | 5/2015 | Morris et al. | |
| 2015/0330228 | A1 * | 11/2015 | Quach | F01D 5/187 416/95 |
| 2015/0345304 | A1 | 12/2015 | Mongillo et al. | |
| 2016/0090848 | A1 | 3/2016 | Engeli et al. | |
| 2016/0312624 | A1 | 10/2016 | Loricco et al. | |

* cited by examiner

COOLING STRUCTURE FOR A TURBINE COMPONENT

BACKGROUND OF THE INVENTION

The present invention is directed to hot-section turbine components in gas turbine engines, and more specifically to cooling structures of turbine components.

A gas turbine engine includes, in sequential flow order: a compressor, a combustor, and one or more turbines. During operation, air is compressed through the compressor and is mixed with fuel in the combustor. The fuel is ignited in the combustor, generating hot, high energy combustion gases which flow downstream through the turbine stages. The turbine stages extract energy from these combustion gases.

To prolong the service life of turbine blades and other hot section components and to reduce engine operating cost, portions of these components, for example turbine blade tips, often employ "active cooling". This type of cooling is effected by bleeding off pressurized air at a relatively low temperature from some other portion of the engine such as the compressor, and then discharging the bleed air through cooling holes to form a protective film.

One problem with active cooling is that the use of bleed air is expensive in terms of overall fuel consumption.

Another problem with active cooling, particularly for turbine blade tips, is that the cooling holes can be damaged during a "rub" event in which the blade tips contact the surrounding shroud, thus lowering cooling effectiveness.

BRIEF DESCRIPTION OF THE INVENTION

At least one of these problems is addressed by a turbine component cooling structure in which transpiration cooling is effected using air cavities that form an organized matrix of torturous passages. This structure may incorporate a pattern of recessed areas in a blade tip that makes the cooling pattern robust so that it does not get closed by material sacrificed during a rub.

According to one aspect of the technology described herein, a tip cooling apparatus for a turbine airfoil includes: a tip cap; a pair of spaced-apart tip walls connected to, extending around, and projecting outwardly from the tip cap so as to surround a central portion of the tip cap; a pocket defined by the tip walls; at least one feed hole passing through the tip cap or tip walls, communicating with the pocket; and a cooling matrix disposed in the pocket, the cooling matrix being an organized structure including an inlet surface having a plurality of inlets communicating with the pocket, and an outlet surface having a plurality of outlets, and further comprising a plurality of interior passages interconnecting the inlets to the outlets, with no line-of-sight therebetween.

According to another aspect of the technology described herein, a turbine blade includes: a dovetail; a blade shank extending from the dovetail and terminating in a platform that projects laterally outwardly from and surrounds the shank; and an airfoil extending from the platform, the airfoil including: a root, a tip, a leading edge, a trailing edge, a pressure side wall and a suction side wall, and an internal cavity, said internal cavity being bounded at its radially outer end by a tip cap; a squealer tip comprising spaced-apart tip walls extending above said tip cap; a cooling matrix disposed outboard of the tip cap, the cooling matrix being an organized structure including an inlet surface having a plurality of inlets communicating with the interior cavity, and an outlet surface having a plurality of outlets, and further comprising a plurality of interior passages interconnecting the inlets to the outlets, with no line-of-sight therebetween.

According to another aspect of the technology described herein, a turbine component includes: a flowpath wall defining a flowpath surface configured to be exposed in operation to a hot gas flow, the flowpath wall having a backside opposite to the flowpath surface which forms part of the boundary of an internal cooling circuit of the component; a pocket defined within the flowpath wall; at least one feed hole formed in the flowpath wall communicating with the pocket; and a cooling matrix disposed in the pocket, the cooling matrix being an organized structure including an inlet surface having a plurality of inlets communicating with the pocket, and an outlet surface having a plurality of outlets, and further comprising a plurality of interior passages interconnecting the inlets to the outlets, with no line-of-sight therebetween.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
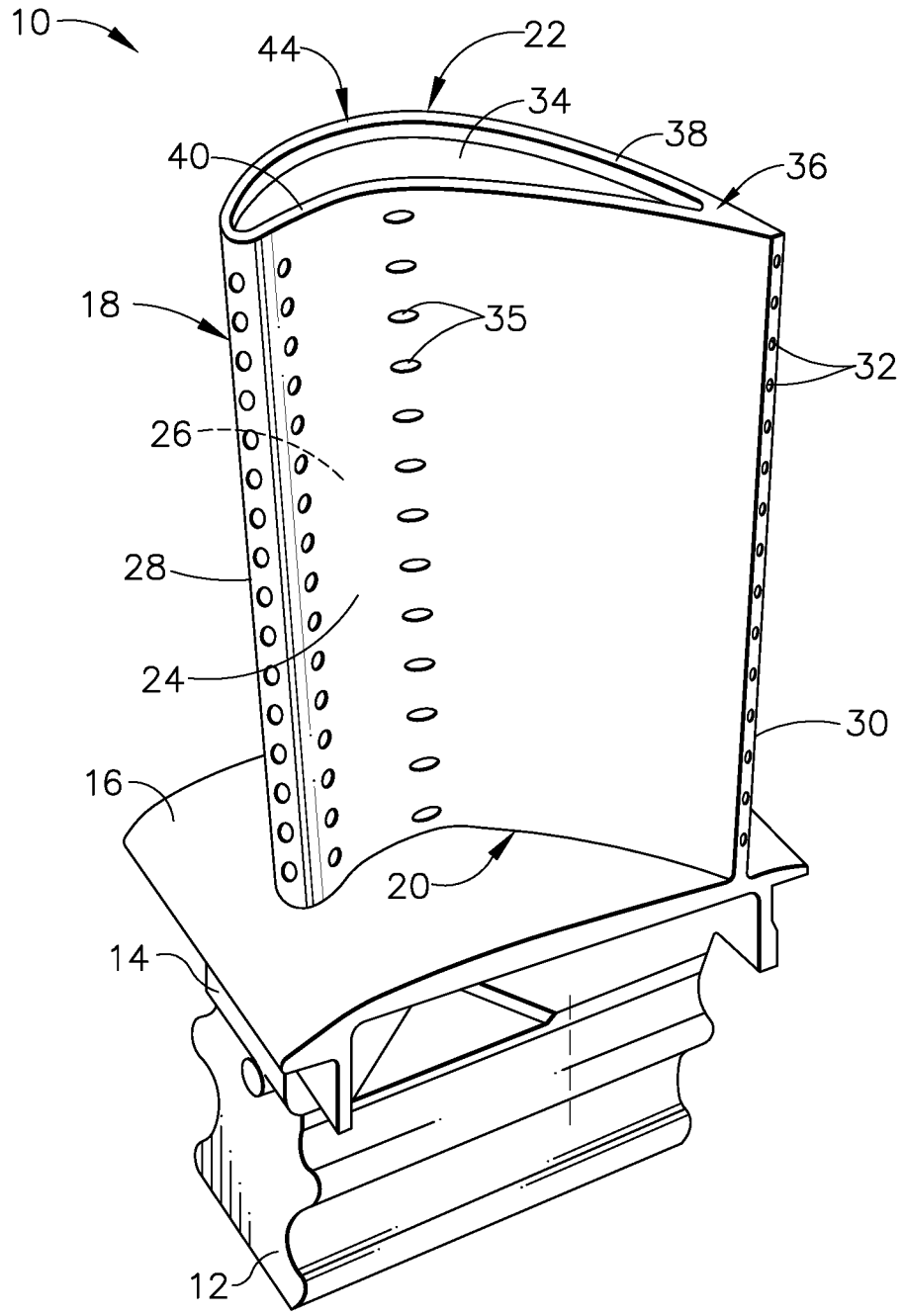
FIG. 1 is a perspective view of a high-pressure turbine blade incorporating a tip cooling structure.

Referring to the drawings wherein identical reference numerals denote the same elements throughout the various views, FIG. 1 depicts an exemplary turbine blade 10. The turbine blade 10 includes a conventional dovetail 12, which may have any suitable form including tangs that engage complementary tangs of a dovetail slot in a rotor disk (not shown) for radially retaining the blade 10 to the disk as it rotates during operation. A blade shank 14 extends radially upwardly from the dovetail 12 and terminates in a platform 16 that projects laterally outwardly from and surrounds the shank 14. A hollow airfoil 18 extends radially outwardly from the platform 16 and into the hot gas stream. The airfoil has a root 20 at the junction of the platform 16 and the airfoil 18, and a tip 22 at its radially outer end. The airfoil 18 has a concave pressure side wall 24 and a convex suction side wall 26 joined together at a leading edge 28 and at a trailing edge 30. The airfoil 18 may take any configuration suitable for extracting energy from the hot gas stream and causing rotation of the rotor disk. The turbine blade 10 may be formed from a suitable aerospace alloy, such as a nickel- or cobalt-based superalloy, which has acceptable strength at the elevated temperatures of operation in a gas turbine engine. The tip 22 of the airfoil 18 is closed off by a tip cap 34 which may be integral to the airfoil 18 or separately formed and attached to the airfoil 18.

The airfoil 18 includes an internal cooling circuit (not shown) which may have any conventional configuration, such as a serpentine circuit. The cooling circuit extends through the platform 16 and dovetail 12 and includes inlets in the base of the dovetail 12 for receiving pressurized cooling air from a compressor of the gas turbine engine (not shown) in a conventional manner. In this way, the airfoil 18 is internally cooled by the cooling air which then may be discharged through the thin airfoil sidewalls in various rows of film cooling holes 35 of conventional size and configuration. The airfoil 18 may incorporate a plurality of trailing edge cooling holes 32, or it may incorporate a number of trailing edge bleed slots (not shown) on the pressure side wall 24 of the airfoil 18.

An upstanding squealer tip 36 extends radially outwardly from the tip cap 34 and is disposed in close proximity to a stationary shroud (not shown) in the assembled engine, in order to minimize airflow losses past the tip 22. The tip structure 36 comprises a suction side tip wall 38 disposed in a spaced-apart relationship to a pressure side tip wall 40. The tip walls 40 and 38 form extensions of the pressure and suction side walls 24 and 26, respectively, and may be integral to the airfoil 18. The outer surfaces of the pressure and suction side tip walls 40 and 38 respectively form continuous surfaces with the outer surfaces of the pressure and suction side walls 24 and 26. Radial end faces of the tip walls 40 and 38 define a tip surface 44. According to the principles described herein, the squealer tip 36 may incorporate a cooling matrix configured to provide transpiration cooling of the airfoil tip 22 in operation. FIGS. 2-10 illustrate various examples of airfoil tip structures incorporating such a cooling matrix.

Figure 2:
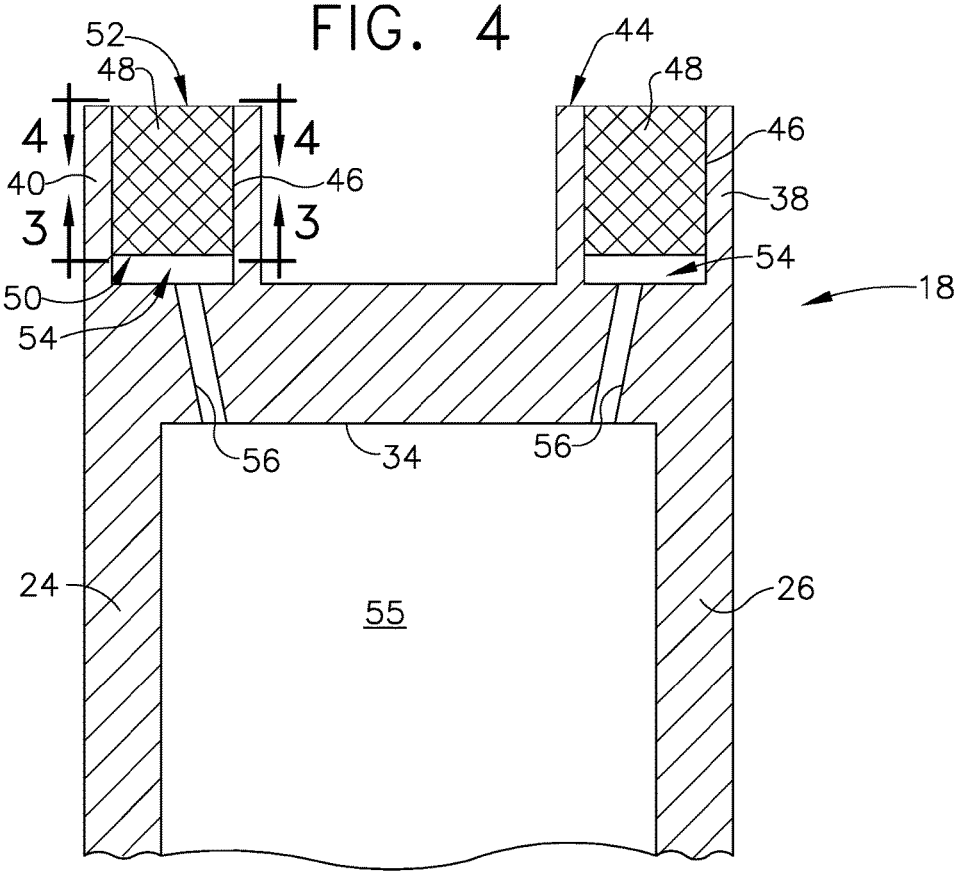
FIG. 2 is a cross-sectional view of a tip section of the turbine blade of FIG. 1, showing a cooling matrix incorporated into tip walls thereof.
Figure 3:
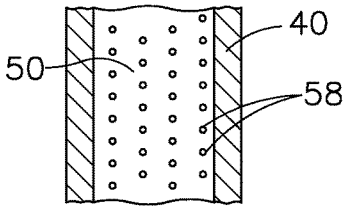
FIG. 3 is a view taken along lines 3-3 of FIG. 2.

In the example shown in FIG. 2, each of the tip walls 38 and 40 has a pocket 46 formed therein. Each pocket 46 has a cooling matrix 48 disposed therein, which extends from an inlet surface 50 to an outlet surface 52. The outlet surface 52 is generally coextensive or "flush" with the tip surface 44. The inlet surface 50 is spaced-away from an innermost surface of the pocket 46, so as to define a plenum 54 between the cooling matrix 48 and the tip cap 34. One or more feed holes 56 pass through the tip cap 34 so as to interconnect the interior cooling circuit 55 of the airfoil 18 with the plenum 54.

Figure 4:
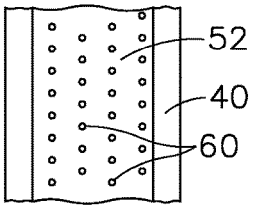
FIG. 4 is a view taken along lines 4-4 of FIG. 2.

The cooling matrix 48 is an organized (i.e. not random) structure defining a tortuous air path extending from a plurality of inlets 58 at the inlet surface (see FIG. 3) to a plurality of outlets 60 at the outlet surface 52 (see FIG. 4). The outlets 60 are sized and spaced so as to be operable for transpiration film cooling, when in operation. For example, the outlets may be circular holes with a diameter of about 0.05-1.3 mm (1.9-51.2 mils). Measured on a volume basis, the cooling matrix 48 may comprise about 50% solid material to about 95% solid material, and about 5% hollow space to about 50% hollow space. The cooling matrix 48 is configured so that no line-of-sight path exists from the inlet surface 50 to the outlet surface 52. Examples of suitable configurations of the cooling matrix 48 are described in more detail below.

Figure 5:
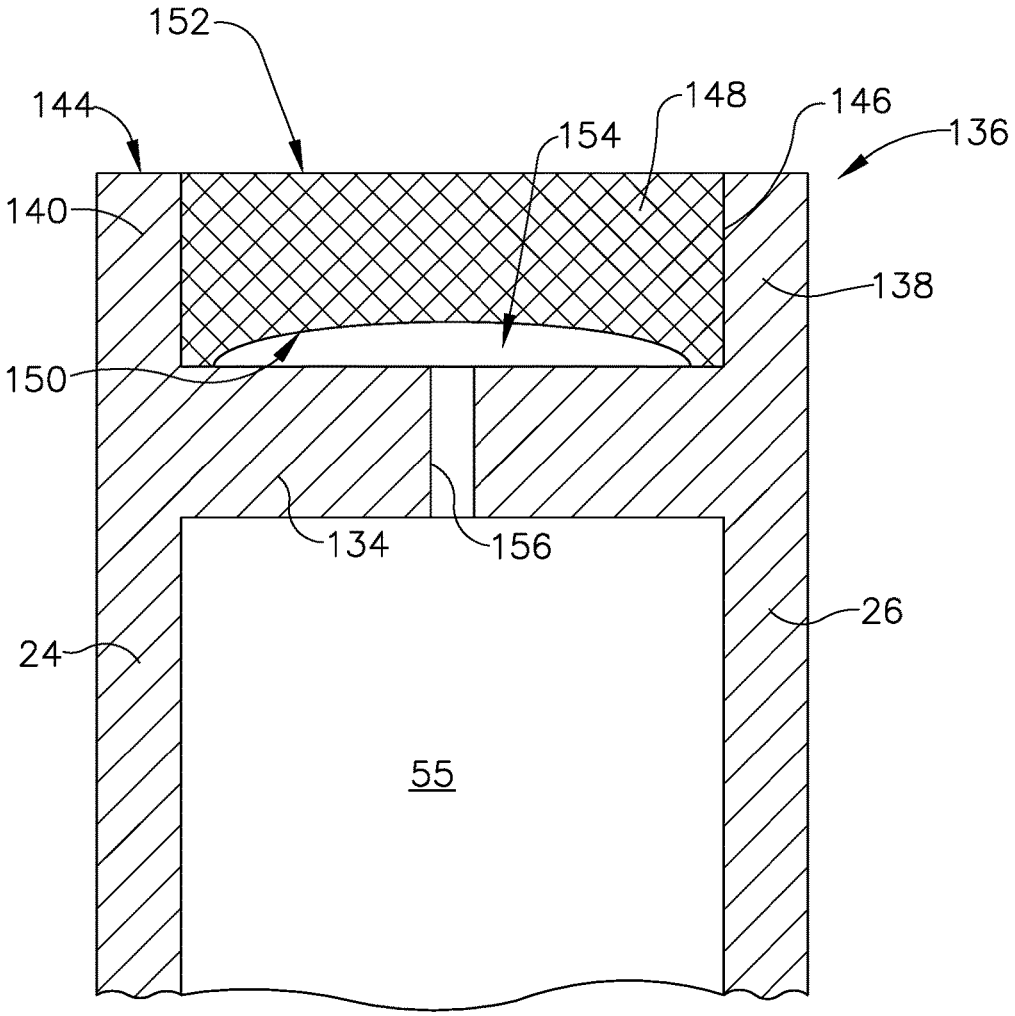
FIG. 5 is a cross-sectional view of an alternative tip section suitable for use with the turbine blade of FIG. 1, showing a cooling matrix incorporated into a tip cap thereof.

FIG. 5 illustrates an alternative tip structure which may be used with the airfoil 18 shown in FIG. 1. The tip structure includes a tip cap 134 which may be integral to the airfoil 18 or separately formed and attached to the airfoil 18. An upstanding squealer tip 136 extends radially outwardly from the tip cap 134 and comprises a suction side tip wall 138 disposed in a spaced-apart relationship to a pressure side tip wall 140. Collectively, distal ends of the tip walls 138, 140 define a tip surface 144 of the airfoil 18. A pocket 146 is defined between the suction side tip wall 138 and the pressure side tip wall 140. A cooling matrix 148 is disposed therein, which extends from an inlet surface 150 to an outlet surface 152. The inlet surface 150 and outlet surface 152 incorporate inlets and outlets, respectively, as described above for the cooling matrix 48 (not shown in FIG. 5). The outlet surface 152 is generally coextensive or "flush" with the tip surface 144. The inlet surface 150 is spaced-away from an outboard surface of the tip cap 134 so as to define a plenum 154 between the cooling matrix 148 and the tip cap 134. One or more feed holes 156 pass through the tip cap 134 so as to interconnect the interior cooling circuit 55 of the airfoil 18 with the plenum 154.

Figure 6:
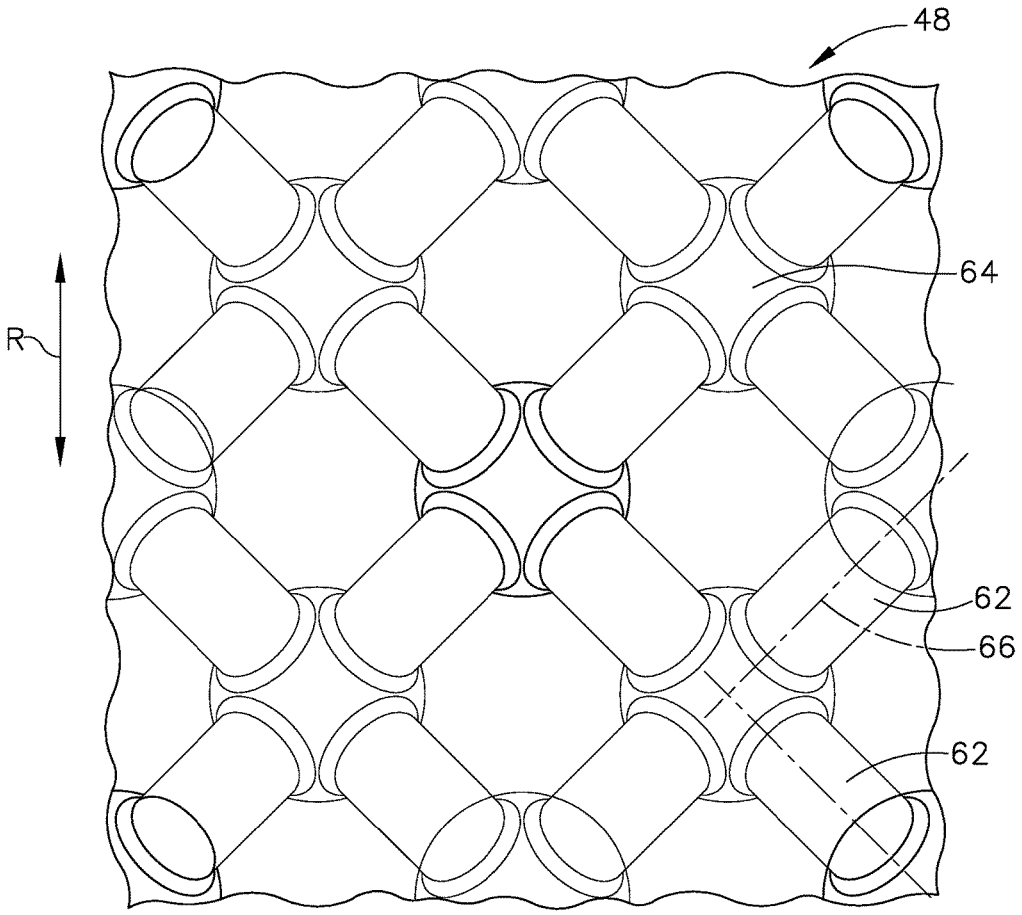
FIG. 6 is a schematic side elevation view of an exemplary cooling matrix.
Figure 7:
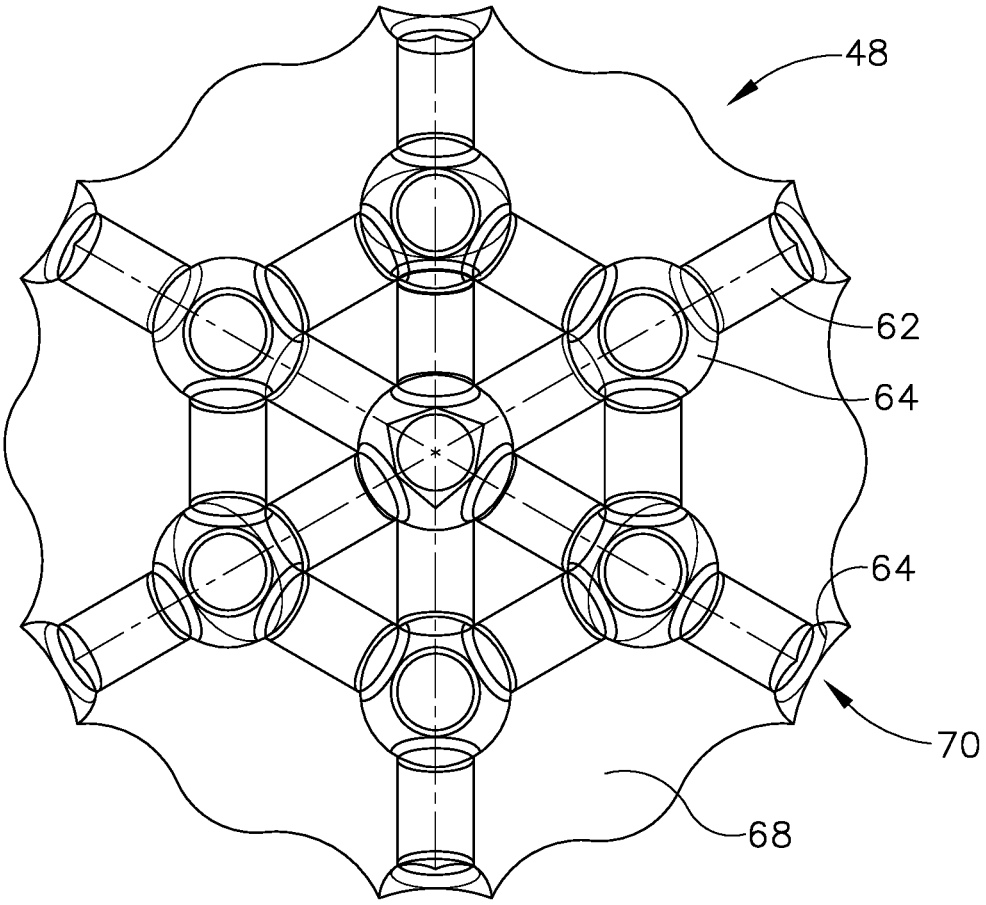
FIG. 7 is a schematic perspective view of the cooling matrix of FIG. 6 arranged into a cubic lattice.

FIGS. 6 and 7 illustrate an example of a suitable configuration of the cooling matrix 48, which comprises a plurality of interior passages formed in an otherwise solid structure. The inlets and outlets described above are defined by intersections of the interior passages with the inlet and outlet surfaces, respectively. In this example, the passages comprise a plurality of tubes 62 which are interconnected to each other at their intersections by spherical hubs 64, forming a lattice-like arrangement.

At least some of the tubes 62 are configured with their centerlines 66 extending at a non-parallel angle to a radial direction "R" of the airfoil 18. The tubes 62 may also be configured such that at least some of the tubes intersecting a given one of the hubs 64 are not aligned coaxially with each other. Stated another way, the central axes of two tubes meeting at a common hub 64 may be arranged so they form an acute angle. The combination of these features guarantees that no line-of-sight exists along the radial direction R.

As shown in FIG. 7, the tubes 62 can be arranged in a modular configuration such as a cube 68 in which each corner 70 terminates at a portion of a hub 64. This permits simple "stacking" of the cubes 68 in a 3-D arrangement to fill a designated volume.

Figure 8:
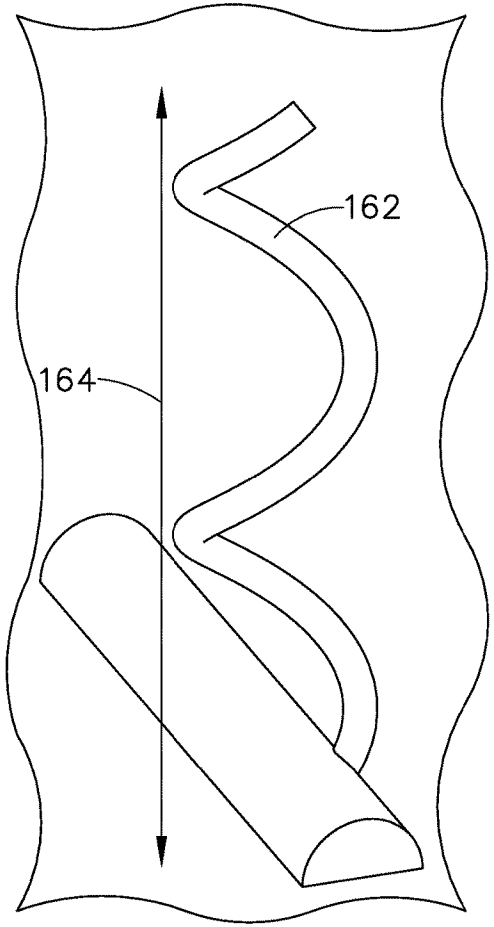
FIG. 8 is a schematic perspective view of an alternative cooling matrix incorporating helical passages.

FIG. 8 illustrates an example of an alternative suitable configuration for the interior passages of the cooling matrix. In this example, the passage structure comprises a plurality of closely-spaced tubes 162, each tube 162 extending in a helical path extending generated about an axis 164 which may be parallel to the radial direction R. In the example shown in FIG. 8, each tube 162 follows a helical path winding in a single direction (e.g. clockwise) about the axis 162 referred to herein as a "single helix".

Figure 10:
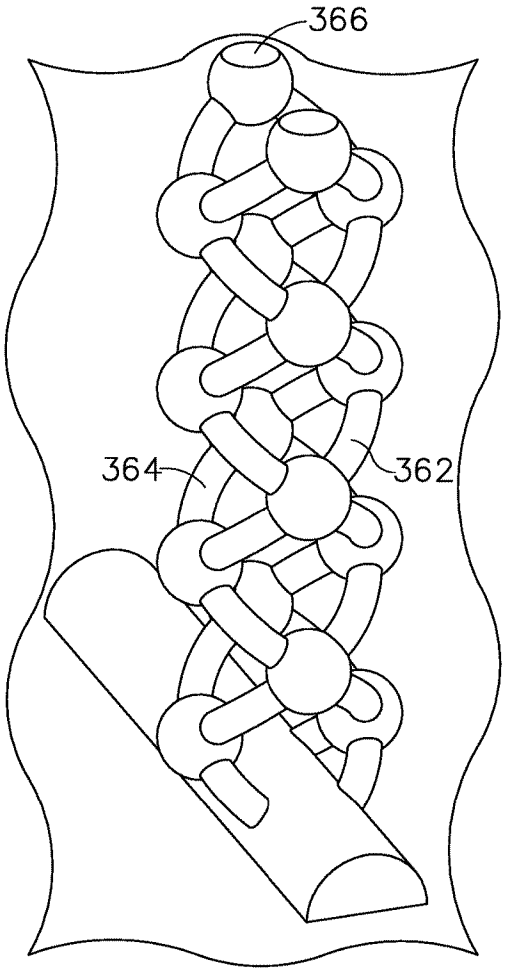
FIG. 10 is a schematic perspective view of another alternative cooling matrix incorporating helical passages.
Figure 9:
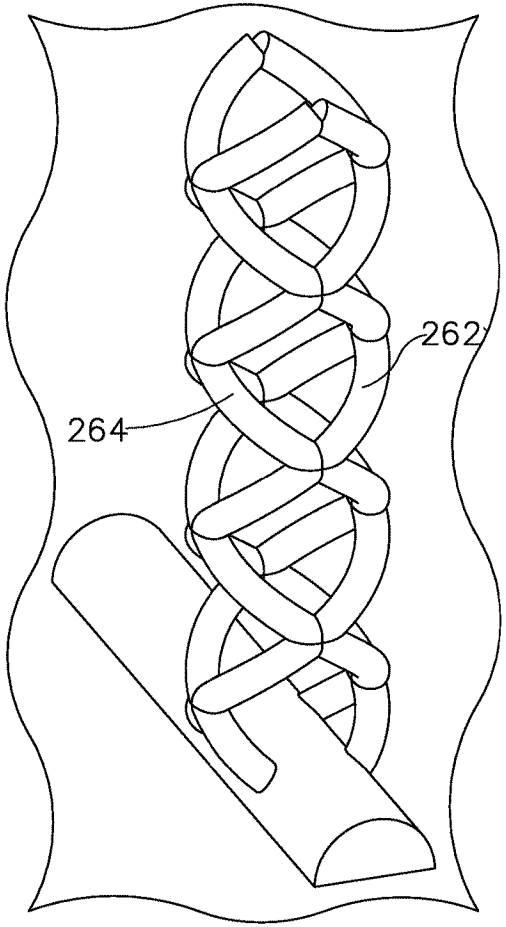
FIG. 9 is a schematic perspective view of another alternative cooling matrix incorporating helical passages.

In another example shown in FIG. 9, pairs of adjacent tubes 262, 264 follow helical paths rotating in opposite directions (e.g. clockwise versus counter-clockwise), and intersect each other at regular intervals, referred to herein as a "double helix" structure. Optionally, as shown in FIG. 10, pairs of adjacent tubes 362, 364 forming a double helix may be provided, with hubs 366 as described above disposed at the intersections of individual tubes 362, 364.

The operation of the cooling matrix 48 may be understood with reference to FIG. 2. Pressurized cooling air flow is provided through the feed holes 56. This air then enters the plenum 54 and the inlets 58. As the cooling air flows through the torturous path in the cooling matrix 48, there is substantial conductive heat transfer into the cooling air. As the cooling air then exits the outlets 60, it discharges a transpiration cooling film on the tip surface 44.

In operation, it is possible that the rotating blade tip 22 may contact the surrounding shroud, an event known as a "rub". During a rub, the forces involved may tend to have an effect of laterally displacing or "smearing" material at the tip of the blade. In a conventional turbine airfoil using transpiration film cooling holes in the tip, the laterally-displaced material can close off the transpiration film cooling resulting in a loss of cooling effectiveness.

Figure 11:
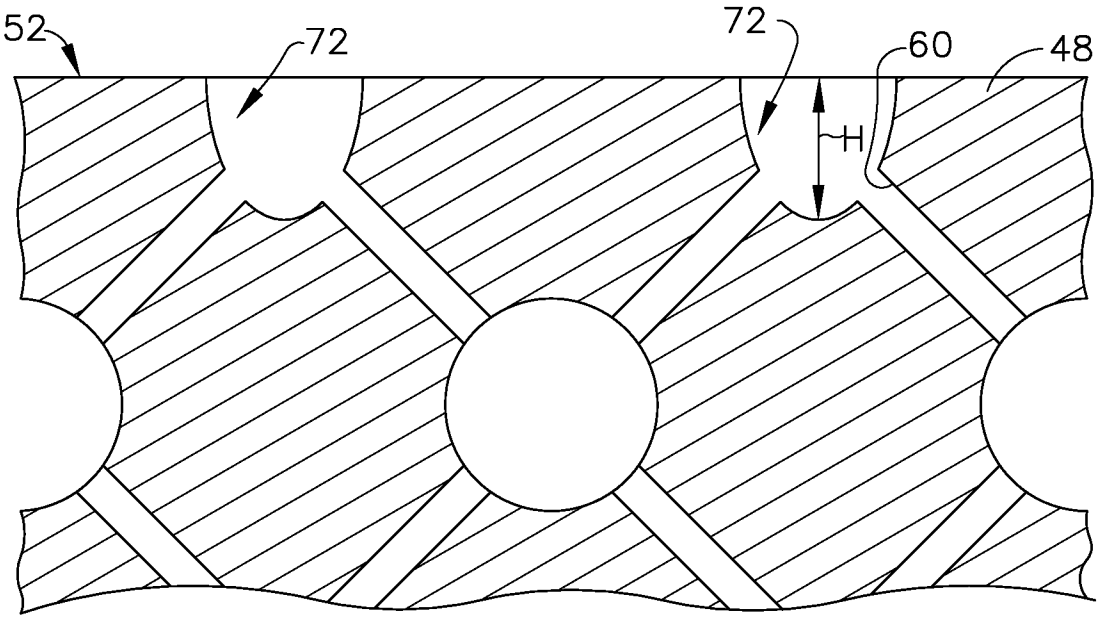
FIG. 11 is a schematic cross-sectional view of an airfoil tip surface incorporating recesses.

To counteract this effect and provide continued cooling effectiveness despite rubs, the cooling matrix 48 may configured to be rub-resistant, as illustrated in FIG. 11. This may be done by incorporating a plurality of recesses 72 in the cooling matrix 48 at the outlet surface 52. The passages within the cooling matrix 48 are configured to communicate with these recesses 72 such that the outlets 60 discharge into the recesses 72. The recesses have a radial height "H" measured from the outlets 60 to the outlet surface 52 selected to be at least equal to the deepest "rub" expected. Using this configuration, the cooling effectiveness is not affected even if a rub occurs. Additionally, the recesses 72 can be configured to improve flow leakage over the tip 22. In particular, the recesses 72 may be aligned perpendicular to a direction of flow.

Figure 12:
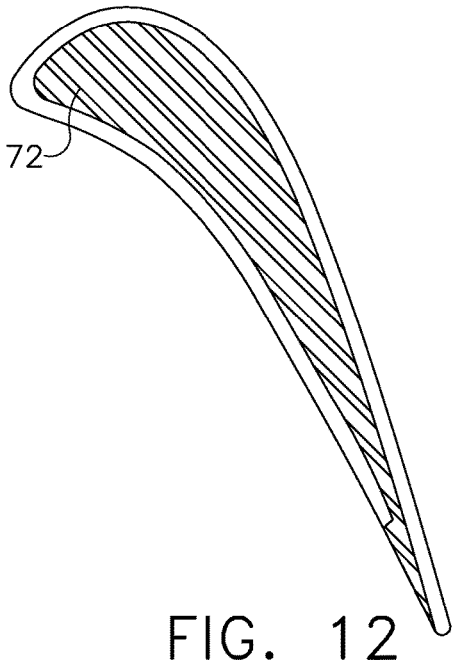
FIG. 12 is a schematic end view of an airfoil tip surface depicting a cooling matrix having recesses configured as a plurality of troughs or grooves.

FIG. 12 shows an example of recesses 72 configured as a plurality of side by side troughs or grooves 72 consistent with the cooling matrix being incorporated into the tip cap as shown in FIG. 5.

Figure 13:
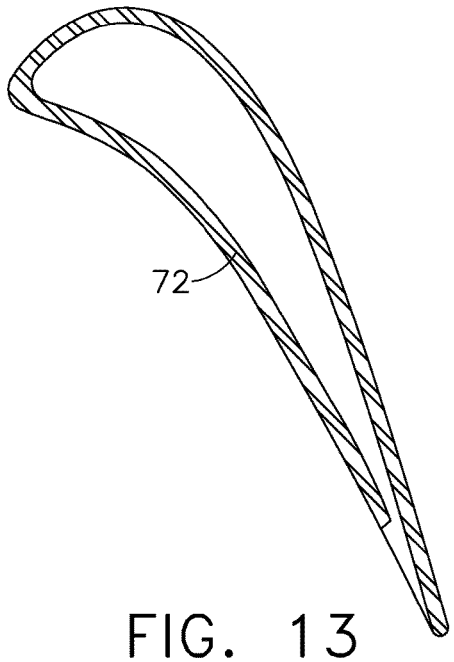
FIG. 13 is a schematic end view of an alternative airfoil tip surface depicting a cooling matrix having recesses configured as a plurality of troughs or grooves.

FIG. 13 shows an example of recesses 72 configured as a plurality of side by side troughs or grooves consistent with the cooling matrix being incorporated into the tip walls of the airfoil as shown in FIG. 2.

Figure 14:
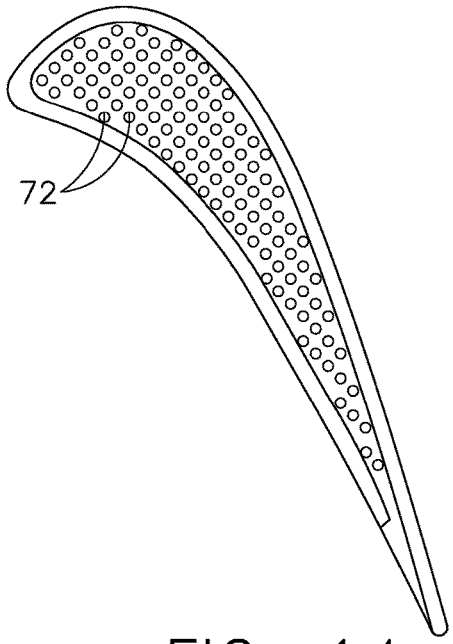
FIG. 14 is a schematic end view of an airfoil tip surface depicting a cooling matrix having recesses configured as a plurality of dimples.

FIG. 14 shows an example of recesses configured as a plurality of rounded dimples, consistent with the cooling matrix being incorporated into the tip cap as shown in FIG. 5.

Figure 15:
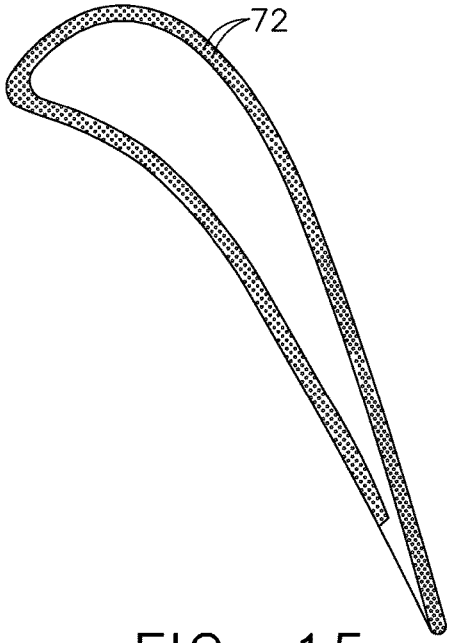
FIG. 15 is a schematic end view of an alternative airfoil tip surface depicting a cooling matrix having recesses configured as a plurality of dimples.

FIG. 15 shows an example of recesses 72 configured as a plurality of rounded dimples, consistent with the cooling matrix being incorporated into the tip walls as shown in FIG. 2.

All or part of the tip structure described above, including the tip walls and the cooling matrix, or portions thereof, may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being the term used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Stereolithography (SLS), Electron Beam Melting (EBM), Laser Engineered Net Shaping (LENS), and Direct Metal Deposition (DMD). It is believed that the cooling matrix configurations described above cannot be created, or could not be practically manufactured, using a conventional (non-additive) method.

In one example, the cooling matrix may be formed using an additive manufacturing process, and then installed into the pockets described above, for example using a conventional brazing process.

In another example, additive manufacturing processes may be used to form the cooling matrix described herein as well as solid structure in the same monolithic element. For example, certain elements have been described as having solid walls forming a pocket with a cooling matrix disposed therein. It will be understood that an additive manufacturing process could be used to build both of those elements simultaneously, with the portion designated as being the cooling matrix incorporating the internal passages described above, and the portions described as solid structure lacking internal passages.

The tip structure described herein has advantages over the prior art. The cooling configuration is more effective than conventional convection or conduction cooling. First, it creates transpiration film on the tip cap surface by creating a high pressure reduction. Second, it creates a torturous path in the organized matrix of air passages that induces a large heat transfer coefficient.

Furthermore, the optional pattern of recessed areas makes the tip robust to rubs by recessing part of the air orifices below the rub height allowed for on the tip.

Cooling the tip effectively will increase field life of turbine blades, and reduce costs to the customer. Additionally, tip life is important to blade clearances which in turn affect engine performance.

Figure 16:
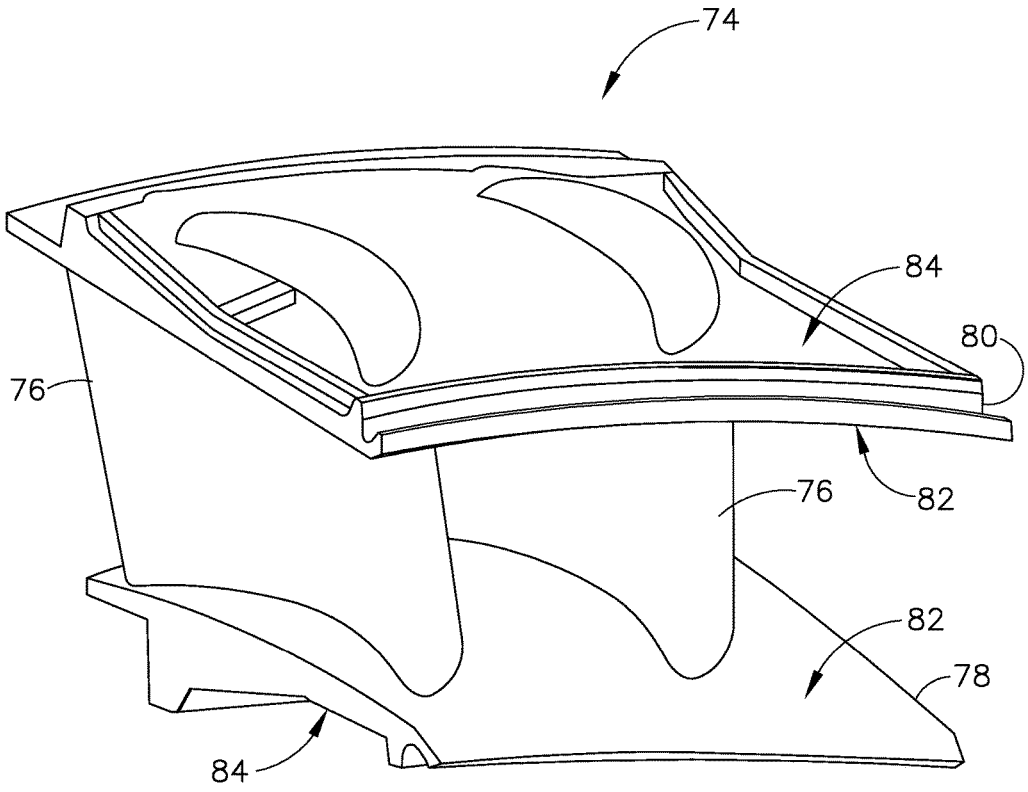
FIG. 16 is a schematic perspective view of a high-pressure turbine nozzle segment incorporating a cooling structure.

The organized cooling matrix 48 described herein may be used to cool elements other than airfoil tips. A gas turbine engine includes numerous hot section components having a surface exposed to a hot gas flow, herein referred to as a "flowpath wall", and any such flowpath wall could incorporate an organized cooling matrix. For example, the platform 16 of the turbine blade 10, as well as its pressure side wall 24 and suction side wall 26, constitute flowpath walls. As another example, FIG. 16 illustrates a turbine nozzle segment 74 comprising a pair of stationary airfoils referred to as turbine vanes 76 extending between an arcuate inner band 78 and an arcuate outer band 80. Each of the bands 78, 80 has a "hot side" surface 82 exposed to the primary gas flowpath during engine operation and an opposed backside 84. Any of the exterior surfaces of the vanes 76 or the hot sides 82 may also constitute a "flowpath wall" for the purposes of this invention.

Figure 17:
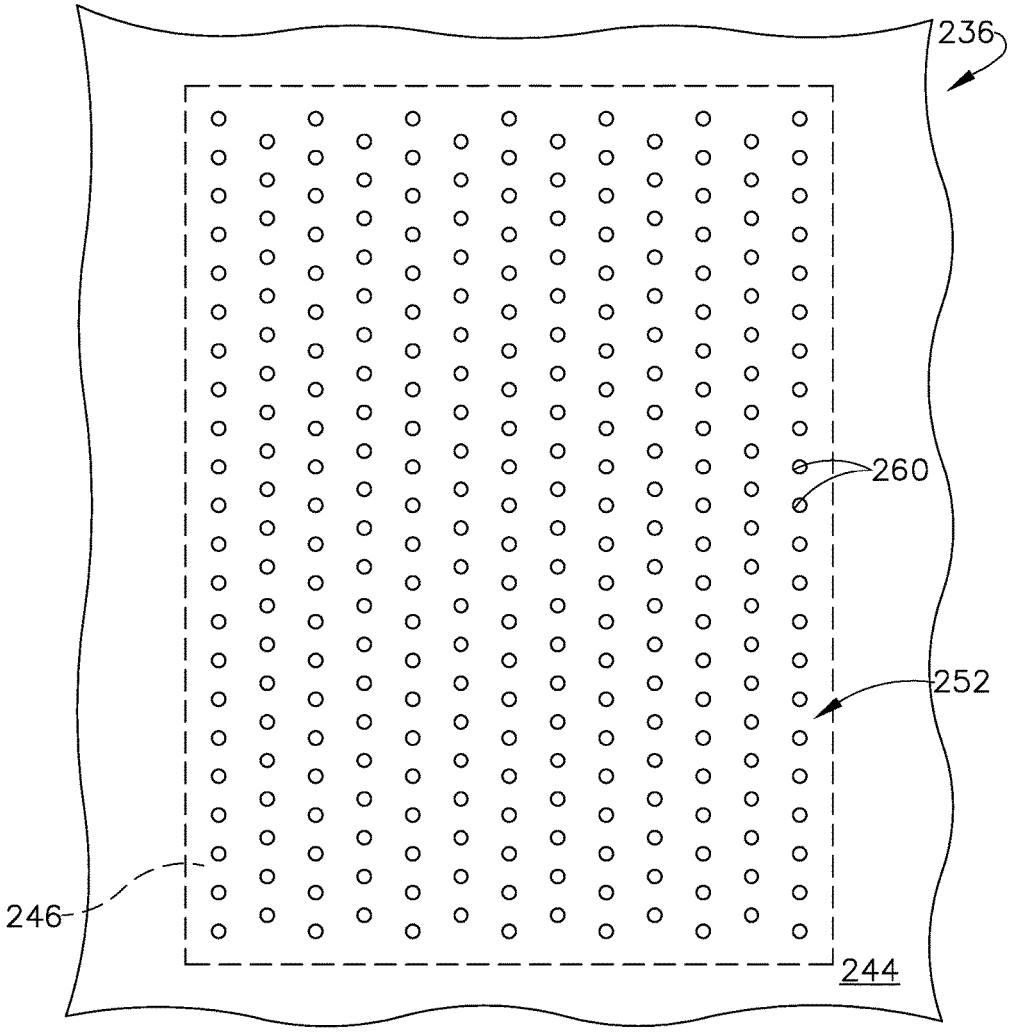
FIG. 17 is a schematic plan view of a portion of a flowpath wall having a cooling structure incorporated therein.
Figure 18:
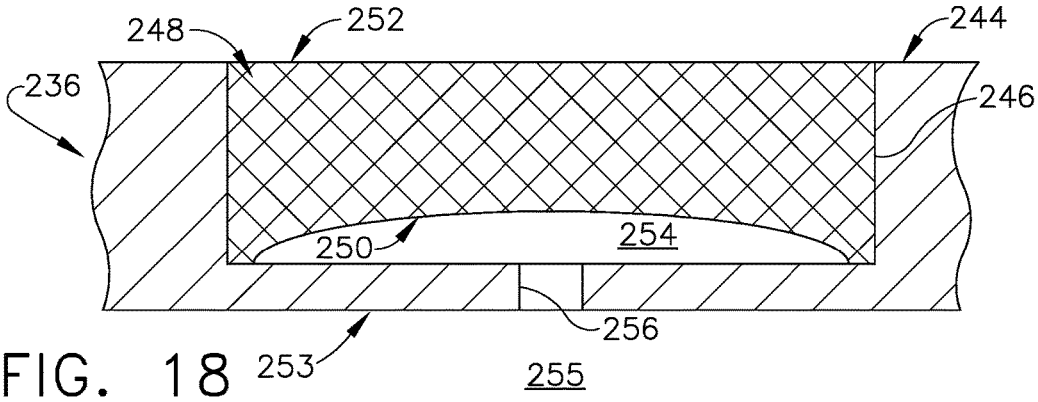
FIG. 18 is a cross-sectional view of the flowpath wall and cooling structure of FIG. 17.

FIGS. 17 and 18 illustrates a generic flowpath wall 236 incorporating a cooling matrix. For example, it is representative of any of the exterior surfaces of the airfoil 18 or the vanes 76, the platform 16, or the bands 78, 80. The flowpath wall 236 defines a flowpath surface 244. A pocket 246 is defined in the thickness of the flowpath wall 236. A cooling matrix 248 is disposed therein, which extends from an inlet surface 250 to an outlet surface 252. The inlet surface 250 and outlet surface 252 incorporate inlets (not shown) and outlets 260, respectively, as described above for the cooling matrix 48. The outlet surface 252 is generally coextensive or "flush" with the flowpath surface 244. The inlet surface 250 is spaced-away from wall of the pocket 246 so as to define a plenum 254 between the cooling matrix 248 and the pocket 246. A backside 253 of the flowpath wall 236, opposite the flowpath surface 244, forms part of the boundary of an interior cooling circuit 255 of the corresponding component. One or more feed holes 256 formed in the flowpath wall 236 communicate with the interior cooling circuit 255.

In operation, the cooling circuit 255 would be supplied with pressurized cooling air as described above for the turbine blade 10. The function of the cooling matrix 248 is substantially as described above for the cooling matrix 48.

The foregoing has described a cooling structure for a gas turbine engine component. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A tip cooling apparatus for a turbine airfoil, comprising: a tip cap; a pair of spaced-apart tip walls connected to, extending around, and projecting outwardly from the tip cap so as to surround a central portion of the tip cap; a pocket defined by the tip walls; at least one feed hole passing through the tip cap or tip walls, communicating with the pocket; and a cooling matrix disposed in the pocket, the cooling matrix being an organized structure including an inlet surface having a plurality of inlets communicating with the pocket, and an outlet surface having a plurality of outlets, and further comprising a plurality of interior passages interconnecting the inlets to the outlets, with no line-of-sight therebetween, wherein the plurality of interior passages are configured to define cubic repeating modules.

2. The apparatus of claim 1 wherein the outlet surface is coextensive with a tip surface defined by the tip walls.

3. The apparatus of claim 1 wherein the pocket is formed within a thickness of one or both of the tip walls.

4. The apparatus of claim 1 where the pocket is defined between the tip walls.

5. The apparatus of claim 1 wherein the outlets have a diameter of about 0.002 to about 0.005 inches.

6. The apparatus of claim 1 wherein a plenum is defined between the inlet surface of the cooling matrix and the pocket.

7. The apparatus of claim 1 wherein the plurality of interior passages comprise a plurality of tubes interconnected by a plurality of hubs.

8. The apparatus of claim 7 wherein two or more of the plurality of tubes intersecting a given one of the plurality of hubs are not aligned coaxially with each other.

9. The apparatus of claim 1 where the plurality of interior passages comprise a helical configuration.

10. The apparatus of claim 1 wherein the plurality of interior passages comprise a single helix.

11. The apparatus of claim 1 where the plurality of interior passages comprise a double helix.

12. The apparatus of claim 9 wherein the helix shapes include hubs at their intersections.

13. The apparatus of claim 1 wherein a plurality of recesses are formed in the outlet surface, and at least some of the outlets intersect the recesses.

14. The apparatus of claim 13 wherein the plurality of recesses comprise a series of spaced-apart grooves.

15. The apparatus of claim 13 wherein the plurality of recesses comprise dimples.

16. A turbine blade, comprising: a dovetail; a blade shank extending from the dovetail and terminating in a platform that projects laterally outwardly from and surrounds the shank; and an airfoil extending from the platform, the airfoil including: a root, a tip, a leading edge, a trailing edge, a pressure side wall and a suction side wall, and an internal cavity, said internal cavity being bounded at its radially outer end by a tip cap; a squealer tip comprising spaced-apart tip walls extending above said tip cap; a cooling matrix disposed outboard of the tip cap, the cooling matrix being an organized structure including an inlet surface having a plurality of inlets communicating with the interior cavity, and an outlet surface having a plurality of outlets, and further comprising a plurality of interior passages interconnecting the inlets to the outlets, with no line-of-sight therebetween, wherein the plurality of interior passages are configured to define cubic repeating modules.

17. The turbine blade of claim 16 wherein the outlet surface is coextensive with a tip surface of the airfoil defined by the walls of the squealer tip.

18. The turbine blade of claim 16 wherein a plenum is defined between the inlet surface and the tip cap.

19. The turbine blade of claim 16 wherein a plurality of recesses are formed in the outlet surface, and at least some of the outlets intersect the recesses.

20. A turbine component, comprising: a flowpath wall defining a flowpath surface configured to be exposed in operation to a hot gas flow, the flowpath wall having a backside opposite to the flowpath surface which forms part of the boundary of an internal cooling circuit of the component; a pocket defined within the flowpath wall; at least one feed hole formed in the flowpath wall communicating with the pocket; and a cooling matrix disposed in the pocket, the cooling matrix being an organized structure including an inlet surface having a plurality of inlets communicating with the pocket, and an outlet surface having a plurality of outlets, and further comprising a plurality of interior passages interconnecting the inlets to the outlets, with no line-of-sight therebetween, wherein the plurality of interior passages are configured to define cubic repeating modules.

21. The turbine component of claim 20 wherein the outlet surface is coextensive with the flowpath surface.

22. The turbine component of claim 20 wherein a plenum is defined between the inlet surface of the cooling matrix and the pocket.

* * * * *